US009392883B2

(12) United States Patent
Kologe

(10) Patent No.: US 9,392,883 B2
(45) Date of Patent: Jul. 19, 2016

(54) DISPLAY TRAY PUSHER PADDLE WITH MANUAL LOCKING DEVICE

(71) Applicant: Joseph F. Kologe, Scranton, PA (US)

(72) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 228 days.

(21) Appl. No.: 14/080,196

(22) Filed: Nov. 14, 2013

(65) Prior Publication Data

US 2015/0129520 A1 May 14, 2015

(51) Int. Cl.
*A47F 1/12* (2006.01)

(52) U.S. Cl.
CPC ..... *A47F 1/126* (2013.01); *A47F 1/125* (2013.01)

(58) Field of Classification Search
CPC ..... A47F 1/125; A47F 1/126; A47F 1/04; A47F 1/128; A47F 1/121; A47F 3/14; A47F 3/147; A47F 5/0025; A47F 5/0056; A47F 5/01; A47F 5/08; A47F 5/0838
USPC ..... 211/59.2, 59.3, 59.4
See application file for complete search history.

(56) References Cited

U.S. PATENT DOCUMENTS 5,240,125 A * 8/1993 Kunz ..... A47F 1/126 211/59.3
5,450,969 A * 9/1995 Johnson ..... A47F 1/126 211/59.3
5,855,283 A * 1/1999 Johnson ..... A47F 1/126 211/103
6,142,317 A * 11/2000 Merl ..... A47F 1/126 211/184
6,745,906 B1 * 6/2004 Nagel ..... A47F 1/126 211/59.3
7,293,663 B2 * 11/2007 Lavery, Jr. ..... A47F 1/126 211/49.1
7,458,473 B1 * 12/2008 Mason ..... A47F 1/126 211/175
7,681,744 B2 * 3/2010 Johnson ..... A47F 1/126 211/59.3
7,918,353 B1 * 4/2011 Luberto ..... A47F 1/126 211/59.3
7,931,156 B2 4/2011 Hardy
8,210,367 B2 7/2012 Nagel et al.
8,453,851 B2 * 6/2013 Ciesick ..... A47F 1/04 211/126.15
8,720,702 B2 * 5/2014 Nagel ..... A47B 96/027 211/193
8,820,545 B2 * 9/2014 Kologe ..... A47F 5/0025 211/59.3

(Continued)

FOREIGN PATENT DOCUMENTS

EP 0986980 A1 3/2000
GB 2290077 A 12/1995

*Primary Examiner* — Patrick Hawn
(74) *Attorney, Agent, or Firm* — St. Onge Steward Johnston & Reens LLC

(57) ABSTRACT

A product display tray, which is provided with a spring-actuated pusher paddle for urging a column of products forwardly in a display as items are removed from the front of the tray, includes a manually operated locking element pivotally attached to the pusher paddle and normally held in a "release" position by the action of the pusher spring. When the paddle is in a fully retracted position, for reloading of the tray, the locking element is manually pivoted into a locking position to engage the tray structure and retain the paddle in its retracted position during loading operations. A slight backward push on the paddle, when reloading has been completed, releases the paddle for forward movement by the spring. The device also includes special features on the pusher paddle to facilitate and simplify its slideable assembly with, and stable retention on, longitudinal guide rods on which the paddle slides.

9 Claims, 10 Drawing Sheets

(56) References Cited

U.S. PATENT DOCUMENTS 8,893,901 B2 * 11/2014 Nagel ..... A47B 96/027 211/184
9,016,484 B2 * 4/2015 Kologe ..... A47F 1/125 211/59.3
9,101,230 B2 * 8/2015 Sosso ..... A47F 1/126
9,107,516 B2 * 8/2015 Pichel ..... A47F 1/04
2006/0186065 A1 * 8/2006 Ciesick ..... A47F 1/04 211/59.3
2006/0273053 A1 * 12/2006 Roslof ..... A47F 1/126 211/59.3
2007/0175839 A1 * 8/2007 Schneider ..... A47F 3/14 211/59.3
2010/0108624 A1 * 5/2010 Sparkowski ..... A47F 1/126 211/59.3
2010/0176075 A1 * 7/2010 Nagel ..... A47F 1/126 211/59.3
2010/0176077 A1 * 7/2010 Nagel ..... A47F 1/125 211/126.16
2011/0017684 A1 * 1/2011 Nagel ..... A47F 1/126 211/59.3
2011/0210086 A1 * 9/2011 Ciesick ..... A47F 1/126 211/59.3
2012/0211450 A1 8/2012 Kologe
2012/0255924 A1 * 10/2012 Kologe ..... A47F 1/125 211/126.15
2013/0112634 A1 5/2013 Nagel
2014/0190914 A1 * 7/2014 Nagel ..... A47B 96/027 211/59.3

* cited by examiner

DISPLAY TRAY PUSHER PADDLE WITH MANUAL LOCKING DEVICE

FIELD OF THE INVENTION

The present invention is directed to trays for the display of merchandise, particularly in supermarkets and other large stores. The invention is especially suitable for, but not necessarily limited to, merchandise display trays of the type that are mounted in cantilever fashion, for example as disclosed in U.S. Pat. No. 8,210,367, and which are provided with spring-operated pusher paddles that constantly urge the displayed merchandise forwardly as products are removed by customers from the front of the display.

BACKGROUND OF THE INVENTION

When loading or reloading product display trays of the type referred to above, the spring-loaded pusher paddle must be held in a retracted position while new product items are loaded into the tray. To enable store personnel to have both hands available for loading of product, it is typical to provide a means for mechanically locking the paddle in a fully retracted position while the loading operations are taking place. A variety of arrangements and mechanisms have been proposed for accomplishing this. One such mechanism is reflected in British patent publication 2290077, in which a vertically movable latch element is mounted on the back of a spring-urged pusher paddle. When the paddle is moved to a retracted position, the latch is depressed so that it engages the track and retains the paddle in position while products are loaded into the tray. When the tray is fully loaded, a push against the paddle in a backward direction releases the latch, which returns to an elevated position allowing the paddle to move forwardly to advance the product column.

European patent EP 0986980 illustrates a basic arrangement in which the base portion of a pusher paddle is provided with a hook engageable with a recess provided in the back portion of the track. When the paddle is retracted for loading of the tray, the entire paddle is tilted backwards to press the hook into the recess and the lock the paddle. The paddle is later released by pressing it backward and tilting it forward to release the hook.

U.S. Pat. No. 7,931,156 illustrates an arrangement similar to that of the British publication 2 290 077 in that a vertically movable latch element is mounted to the back of the pusher paddle. The latch can be depressed when the paddle is in a retracted position, in order to lock the paddle during reloading operations. When reloading is completed, the paddle is pressed rearwardly (either manually or as a result of being pressed backward after becoming fully loaded with packages) causing release of a latch spring and thus allowing the tray to move forwardly under the action of the paddle spring.

US patent publication 2012/0211450, owned by the assignee of this application, Trion Industries, Inc., illustrates an arrangement in which a locking element is positioned against the back face of a flexible and tiltable pusher paddle. During normal operations, the paddle is in an upright position, in which the locking element is ineffective. For reloading operations, the paddle is pushed to the back of the tray, and its geometry is such that it tilts forwardly when in its rearward or reload position. In a forwardly tilted position of the paddle, the locking element grips guide rods forming the base of the tray and retains the paddle in a retracted position. When the paddle is tilted back to an upright position, either manually or by the loading of a final product package into a substantially full tray, the lock automatically releases and allows the paddle to move forwardly under the action of its spring.

US patent publication 2013/0112634 discloses a mechanism in which a U-shaped locking element is inserted through slots in the face of the pusher and has locking elements extending to the rear that automatically engage the tray and lock the pusher when the pusher is moved to a retracted position. Rearward pressure on a portion of the locking element exposed in front of the pusher releases the locking elements and allows the paddle to be pushed forwardly by its spring. This arrangement has the disadvantage of automatically locking the paddle in a retracted position anytime it is moved to the rear of the base. When this happens without the store clerk noticing, the paddle may remain in its locked, retracted position and not function to push the product column to the front as intended.

All of the above devices function at some level to allow a spring operated pusher paddle to be locked in a retracted position for reloading operations. However, all of them suffer from certain shortcomings, either from an operating standpoint or from extra cost and complication in the manufacture.

SUMMARY OF THE INVENTION

The present invention provides a novel and improved form of product display tray including a product pusher of relatively rigid construction which is biased in a forward direction by a coiled strip spring. The coiled strip spring is arranged in a known manner, with a coiled body portion thereof being positioned behind and bearing forwardly upon the product pusher, and a strip portion thereof extending forwardly in the tray and being anchored at the front of the tray. The new tray includes a novel and improved locking mechanism functioning in combination with the spring-driven pusher to accommodate manual locking of the pusher in a retracted position for reloading of the tray, along with either automatic or manual release of the pusher when reloading has been completed.

The mechanism of the invention includes a locking element that is pivotally secured at the rear of the front panel of the paddle. The locking element has a portion, which can be referred to as an actuating arm, extending upwardly from the pivot axis directly behind the upright front panel, and a second portion, which can be referred to as a locking leg, extending rearwardly from the pivot axis. In accordance with a feature of the invention, the upwardly extending actuating arm of the locking element is interposed between the coiled body of the strip spring and the back of the pusher paddle. Accordingly, in the device of the present invention, the locking element is constantly urged by the coiled spring body into a position in which the rearwardly extending locking leg is held in an elevated position where it cannot make locking engagement with the base of the tray.

In accordance with another aspect of the invention, the front panel of the pusher paddle has an opening which provides access to the actuating arm of the locking element. When the pusher paddle is in a retracted position, and the operator desires to actuate the locking device to hold the pusher in a retracted position, the operator can manually access the actuating arm through the panel opening. By pressing rearwardly on the accessible portion of the actuating arm, the operator can pivot the locking element into a position in which the locking leg engages the base of the tray and secures the paddle in a retracted position. Releasing the paddle, when desired, involves merely pushing rearwardly on the upright panel, either manually or by loading of a final package onto the tray. As soon as the pusher paddle is moved slightly to the rear, the pressure of the coiled spring body on the actuating arm causes the locking element to immediately pivot in a release direction and free the paddle for forward movement.

In accordance with yet another aspect of the invention, a product display tray is provided with a unique design of a rigid pusher paddle. The pusher paddle is designed and constructed to be guided and supported by a plurality (typically four) spaced apart and parallel guide rods that extend longitudinally over the length of the tray to accommodate movement of the pusher paddle between front and back limit positions. Typically, the structure of the tray includes front and back transversely disposed base elements that support the front and back ends of the guide rods. Desirably, the configuration of the pusher paddle is such that it can be assembled with or removed from the guide rods without requiring removal of a base element in order to provide access to the ends of the rods. At the same time, and because of the spring forces applied to the rigid pusher paddle, it is important to assure that the pusher paddle remains assembled with the guide rods unless intentionally removed. To this end, the pusher paddle of the invention incorporates improved guide sleeves that slidably engage the rods and at least certain ones of which include special internal detent projections that require snap-on, snap-off assembly and disassembly, assuring that the pusher paddle will remain attached at all times to the guide rods unless intentionally removed.

The arrangement of the invention is functionally optimal, in that positive action of the operator is required in order to lock the paddle in a retracted position. At the same time, the mechanism of the invention is highly simplified in nature and enables the paddle return spring to serve in the additional capacity of controlling operations of the locking element.

For a more complete understanding of the above and other features and advantages of the invention, reference should be made to the following detailed description of a preferred embodiment of the invention, and to the accompanying drawings.

DETAILED DESCRIPTION OF THE INVENTION

Figure 1:
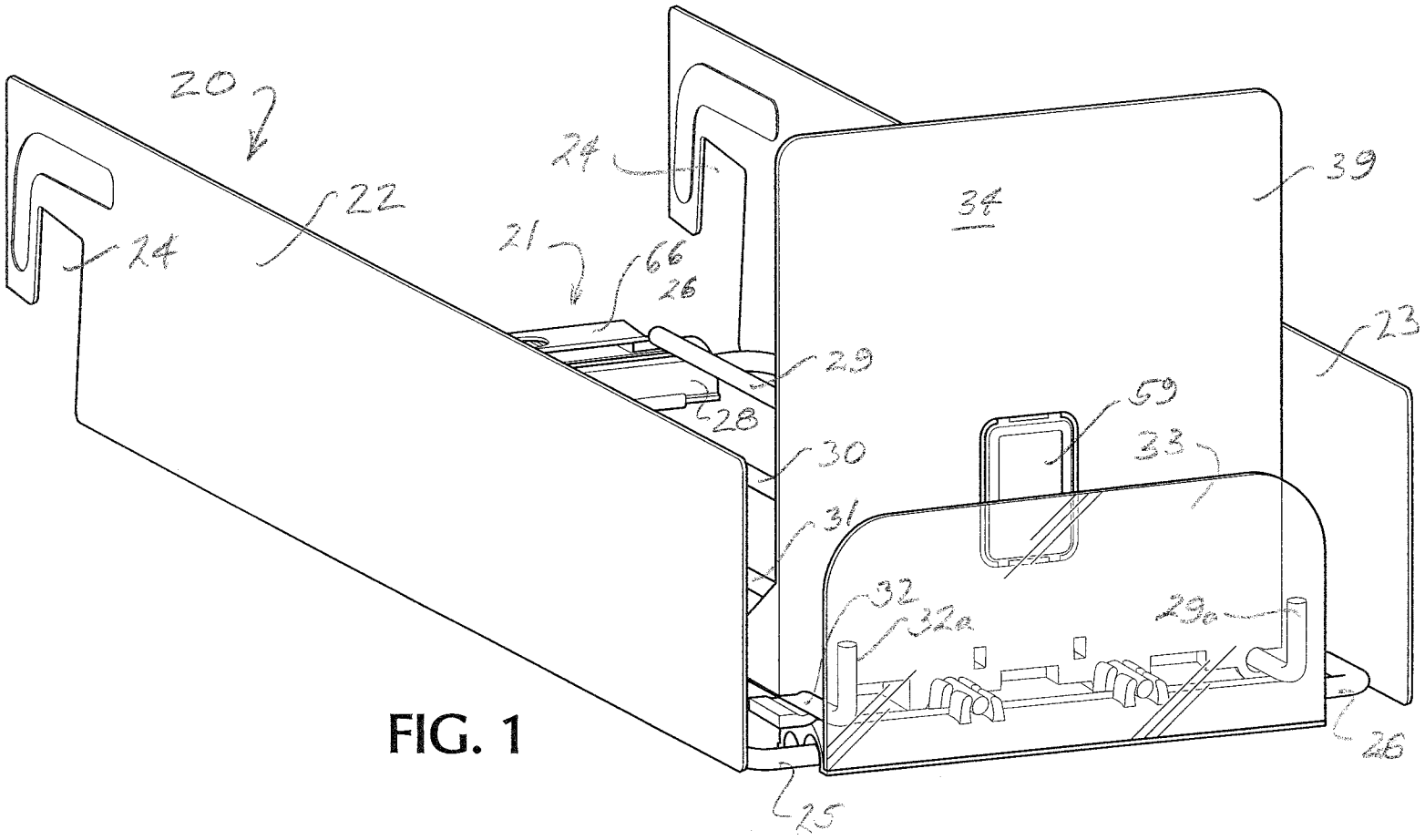
FIG. 1 is a front orthographic view, from above, showing a product display tray incorporating features of the invention.
Figure 2:
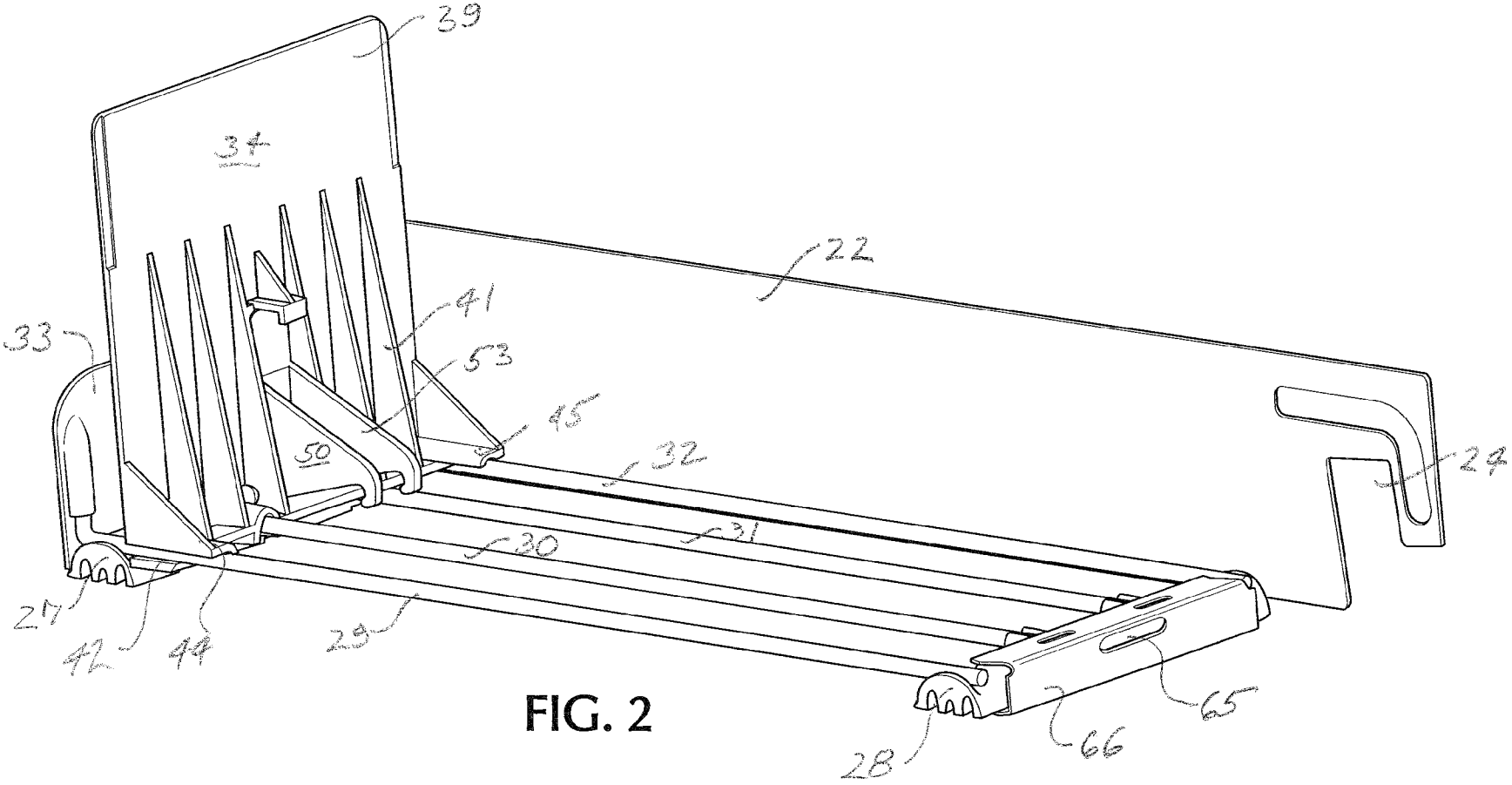
FIG. 2 is a back orthographic view of the tray of FIG. 1, with one side panel removed to show further details and showing the pusher paddle in a forward position.

Referring to the drawings, the reference numeral 20 designates generally a product display tray such as used extensively in supermarkets and other stores. The illustrated tray assembly advantageously, but not necessarily, is of a type disclosed in U.S. Pat. No. 8,210,367, the content of which is incorporated herein by reference. In the illustrated tray assembly, the tray base 21, formed of longitudinally extending, parallel guide rods, is supported in cantilever fashion by laterally spaced apart side wall panels 22, 23. The sidewall panels include notches 24 at the back that engage and are supported by a rectangular mounting bar (not shown). Transversely disposed support rods 25, 26 are mounted at front and back end portions of the respective side wall panels 22, 23. These support rods slidably engage front and back base members 27, 28 such that the base members are supported by the sidewall panels 22, 23 while enabling lateral adjustment of the sidewall panels to accommodate packages of different sizes.

Desirably, the front and back base members 27, 28 extend slightly below the bottom edges of the sidewall panels 22, 23, such that the trays may be directly supported on shelves where desired. Mostly, however, the trays are supported in cantilever fashion.

In the illustrated form of tray, the tray base 21 is comprised of the front and back base members 27, 28 and a plurality of longitudinally extending guide rods 29-32 that are supported at their front and back ends by the base members 27, 28. Crossbars (not shown) extend underneath the guide rods adjacent each end and are welded thereto to form a rigid guide rod structure. The crossbars are received in transverse grooves in the base members 27, 28, preferably by a snap-in attachment, such that the base members and guide rods form a rigid, coherent structure. The outermost guide rods 29, 32 have upwardly bent portions **29*a*, 32*a* at their forward ends which mount a front barrier plate 33. In an illustrative but non-limiting example, the guide rods 29-32** may have a diameter of approximately 3/16 inch.

A pusher paddle 34, details of which are shown in FIGS. 7-10, is mounted on the guide rods 29-32 for forward-backward sliding movement. A coiled strip spring 35 is positioned with a coiled body portion 36 thereof positioned behind the pusher paddle 34, with an uncoiled strip portion **36*a* thereof extending through an opening 37 (FIG. 10) at the base of the pusher paddle 34 and anchored at its forward end 38 by the front base member 27. The coiled spring 35**, in a manner well known to those skilled in the art, applies forward pressure to the paddle to keep the displayed merchandise moving to the front portion of the tray as individual items are removed by customers.

With reference to FIGS. 7-10, the paddle 34 is a one-piece molding of a suitable, relatively rigid plastic material, such as polyvinyl chloride. The paddle includes a front panel 39, which is generally vertically oriented and joins along its bottom edge with a horizontal base panel 40. A plurality of triangular gussets 41 extend between the back surface of the front panel 39 and the base panel 40 to maintain a rigid right angle relationship between the two panels. At its opposite side edges the paddle base 40 is formed with outwardly opening, horizontally disposed guide sleeves 42, 43 of generally U-shaped configuration. At their inner ends, the horizontal guide sleeves 42, 43 are of generally semi-cylindrical form, with their respective axes spaced apart a distance equal to the spacing of the outer guide rods 29, 32. Lower portions of the guide sleeve 42, 43 are of the same width as the base panel 40. However, upper portions 44, 45 of the guide sleeves extend rearwardly beyond the back edge of the base panel 40 and overlie the guide rods 29, 32 over a greater length to provide increased stability to resist backward forces applied during movement of the pusher paddle into a reload position at the back of the tray. By extending the upper portions 44, 45, but not the lower portions of the guide sleeves 42, 43 the paddle 34 can be retracted farther back in the tray for reloading, providing greater room for receiving packages for display. This is evident in FIGS. 4 and 5, for example, which show the extended upper portions 44, 45 overriding the back base member 28. In an illustrative but non-limiting example, the upper portions 44, 45 of the guide sleeves may have a length of about 1.4 inches, while the lower portion may be approximately one-half that length.

For engagement with the inner rods 30, 31 of the base, the paddle 34 is provided with intermediate guide sleeves 46, 47 positioned symmetrically on opposite sides of the center line of the paddle 34. The guide sleeves 46, 47 are of a generally downwardly opening, U-shaped form and are angled divergently at an angle of approximately 30° from the vertical. Preferably, the intermediate guide sleeves 46, 47 are of a length equal to the width of the base panel 40 (e.g., in the above illustrative example, approximately 0.7 inch). At their upper ends, the guide sleeves 46, 47 are of semi-cylindrical form, with their respective axes located at a common level with the axes of the outer guide sleeves 42, 43.

In order to mount the paddle 34 on the guide rods 29-32, the paddle is placed on a mid portion of the guide rods, and both the inner pair of rods 30, 31 and the outer pair 29, 32 are deflected outwardly a short distance to allow the rods to enter the bottom openings of the inner guide sleeves 46, 47 and the side openings of the outer guide sleeves 42, 43. When the guide rods are released from their deflected positions, they can be fully received in the recesses and be seated in the semi-cylindrical closed ends thereof. The four guide sleeves are of the size to closely receive the respective guide rods 29-32, while allowing free sliding movement of the paddle on the rods. In the illustrated and representative tray, the guide rods 29-32 may have a diameter of approximately 3/16 of an inch. However, it will be understood that the rod diameter may vary with the length of the tray and the anticipated weight of the products to be supported thereon. In all cases, the guide sleeves will be correspondingly sized to slide freely on the guide rods while effectively guiding the paddle 34 in its movements thereon.

In accordance with an aspect of the invention, the downwardly opening inner guide sleeves 46, 47 are formed with detent projections 48, 49 which are positioned a short distance in from the open ends of the guide sleeves and serve to partially constrict portions of the guide sleeves in the manner to require forcible snap-in, snap-out assembly and disassembly of the inner guide rods 30, 31 with the pusher 34. The detent projections, which may extend fully or partially along the length of the recesses 46, 47, may constrict the recesses by, for example, 30%. Preferably, the exposed surfaces of the detent projections are disposed at inclined angles to the sides of the recesses. The arrangement is such the guide rods 30, 31 may be partially received in the recesses before encountering the detent projections. The rods must then be forcibly pressed into the recesses in order to deflect the projections and the recess sidewalls enough to allow passage of the guide rods. Likewise, in order to detach the inner guide rods 30, 31 from the paddle 34, the guide rods must be forcibly pressed outward in order to displace and clear the detent projections 48, 49. The described arrangement enables the paddle to resist the tilting action of the spring 35 and also allows the tray and paddle to be roughly handled by store personnel and customers without concern that the paddle will separate from the guide rods. This is accomplished in the present invention without the requirement of using pins, screws or other devices, achieving equivalent functionality without the extra cost and assembly time associated with the use of separate fastening devices.

Effective retention of the sliding pusher paddle 34 on the guide rods is an important consideration, because considerable spring force is acting on the paddle, and it can become a potentially harmful projectile if it accidentally becomes detached from the guide rods.

Figure 10:
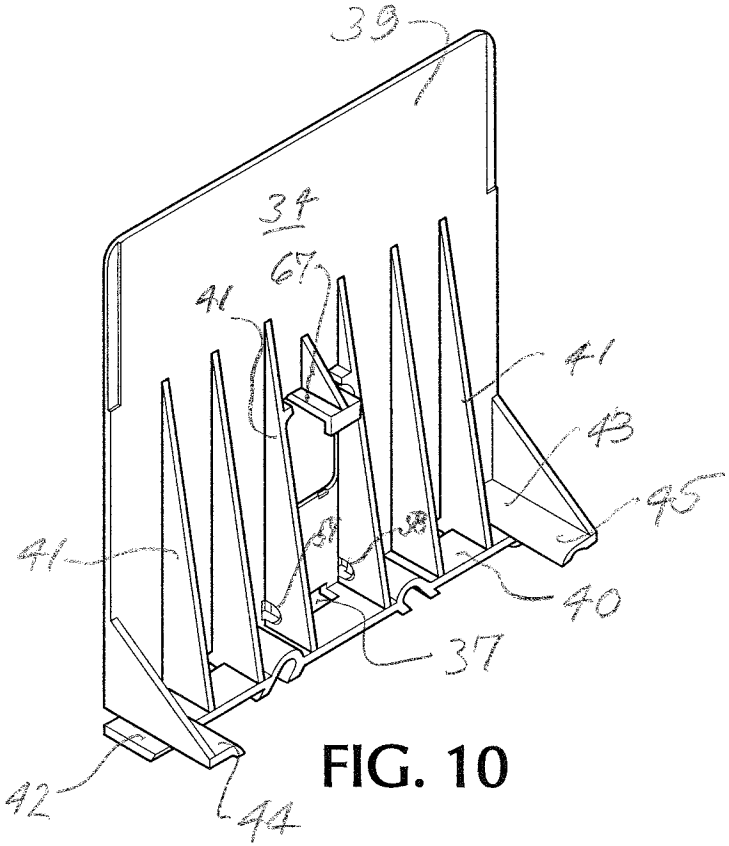
FIG. 10 is a back orthographic view, from above, of the pusher paddle of FIG. 7.
Figure 9:
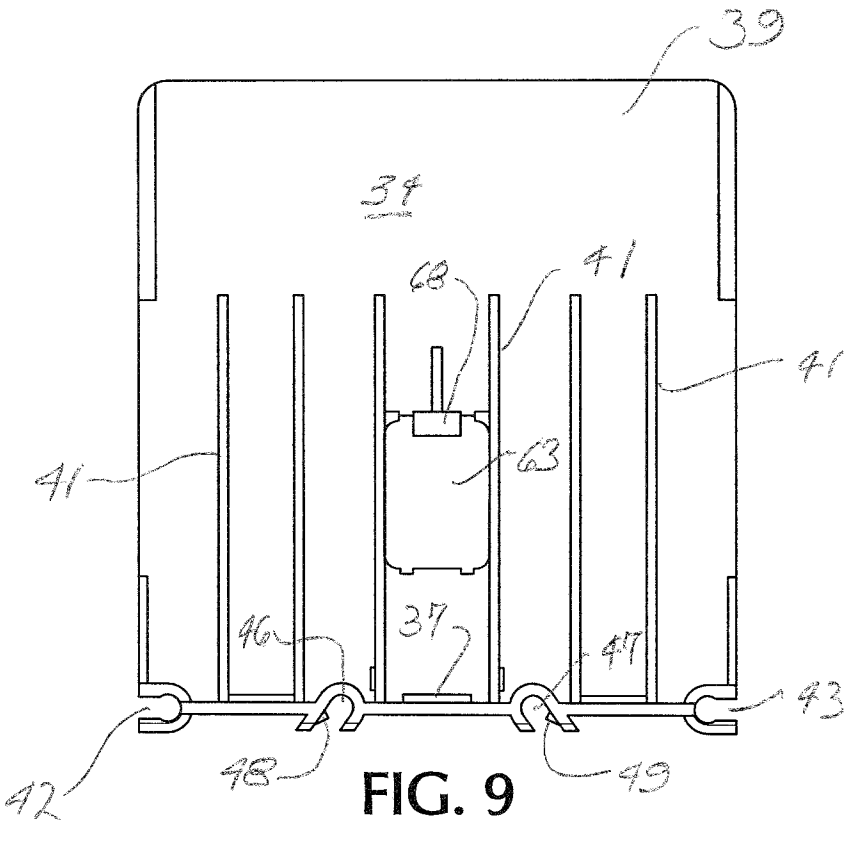
FIG. 9 is a back elevational view of the pusher paddle of FIG. 7.
Figure 12:
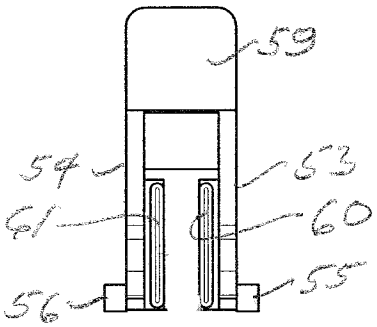
FIG. 12 is back elevational view of the locking element of FIG. 11

In accordance with another aspect of the invention, a novel and improved arrangement is provided for locking the pusher paddle 34 in a fully retracted position, against the action of the coiled spring 35, to accommodate reloading of the tray when necessary. The locking arrangement includes a locking lever 50, shown in FIGS. 11-14, which is pivotally mounted at the back of the pusher 34, closely adjacent to the base panel 40. The locking lever 50 includes an upwardly extending actuating arm portion 51 and a rearwardly extending locking leg portion 52 formed in part by side plates 53, 54. At their lower front corners, the side plates 53, 54 are provided with laterally outwardly extending pivot pins 55, 56 which are arranged to be received in pivot openings 57, 58 formed in lower forward portions of the innermost pair of gussets 41 (FIG. 10). Locking lever 50 is a molded part, designed so that the side plates 53, 54 are joined in the upper portions thereof by a transverse front panel 59. The lower, forward portions of the side plates 53, 54 are free of cross connection and thus can be squeezed inwardly to allow the pivot pins 55, 56 to be inserted into the pivot openings 57, 58, providing a pivotal assembly of the locking lever 50 to the pusher paddle 34. The lateral spacing of the side plates is such that they straddle and confine the spring 35, as shown in FIG. 5.

Flanges 60, 61 extend inwardly a short distance from forward edges 62 of the side plates 53, 54 and are engaged by the coiled body 36 of the spring 35 such that the spring at all times applies a forward pressure on the actuating arm 51 of the locking lever 50, urging it to pivot toward an upright or "release" position. In the normal or release position of the locking lever, the forward edges 62 of the side plates bear against the back surface of the pusher paddle 34 such that the spring acts through the locking lever to urge the paddle in a forward direction.

Figure 3:
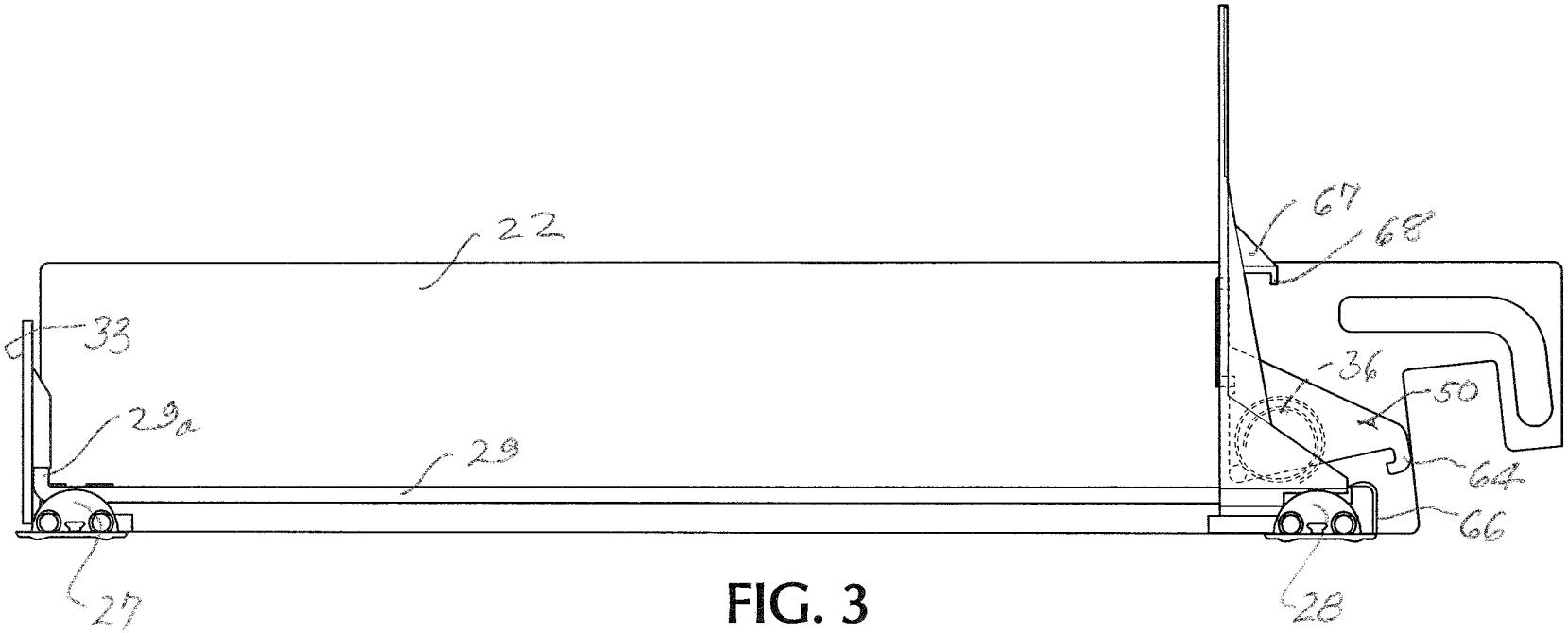
FIG. 3 is a side elevational view of the tray of FIG. 1, with one side panel removed to show further details and showing the pusher paddle in a retracted but unlocked position.
Figure 11:
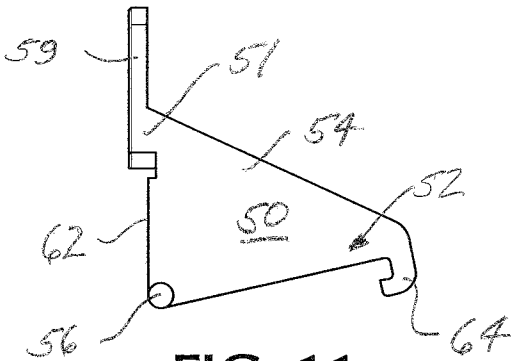
FIG. 11 is a side elevational view of a locking element incorporated in the tray of FIG. 1.
Figure 13:
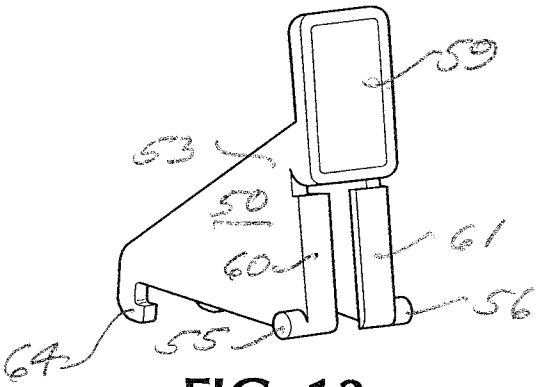

As shown in FIGS. 11 and 13, the front panel 59 of the locking lever is offset forwardly from the forward edges 62 of the side plates 53, 54 and projects into an opening 63 formed in the front panel 39 of the pusher paddle 34. When the locking lever is in its release position (FIG. 3) the panel 59 is approximately flush with the front surface of the pusher panel 39, where it is accessible for actuating the lever 50. When the pusher paddle 34 is moved to a fully retracted position, as in FIG. 4, the locking lever continues to be retained in its release position by the action of the spring body 36 on the flanges 60, 61, so that the paddle is not automatically locked in a retracted position. There are occasions when the paddle is retracted by store personnel for reasons other than reloading of the tray. In such instances, it is undesirable for the paddle to automatically lock in a retracted position because the locking action may not be noticed where it was not intended, causing the tray to malfunction by not maintaining a forward presence of the products.

Figure 4:
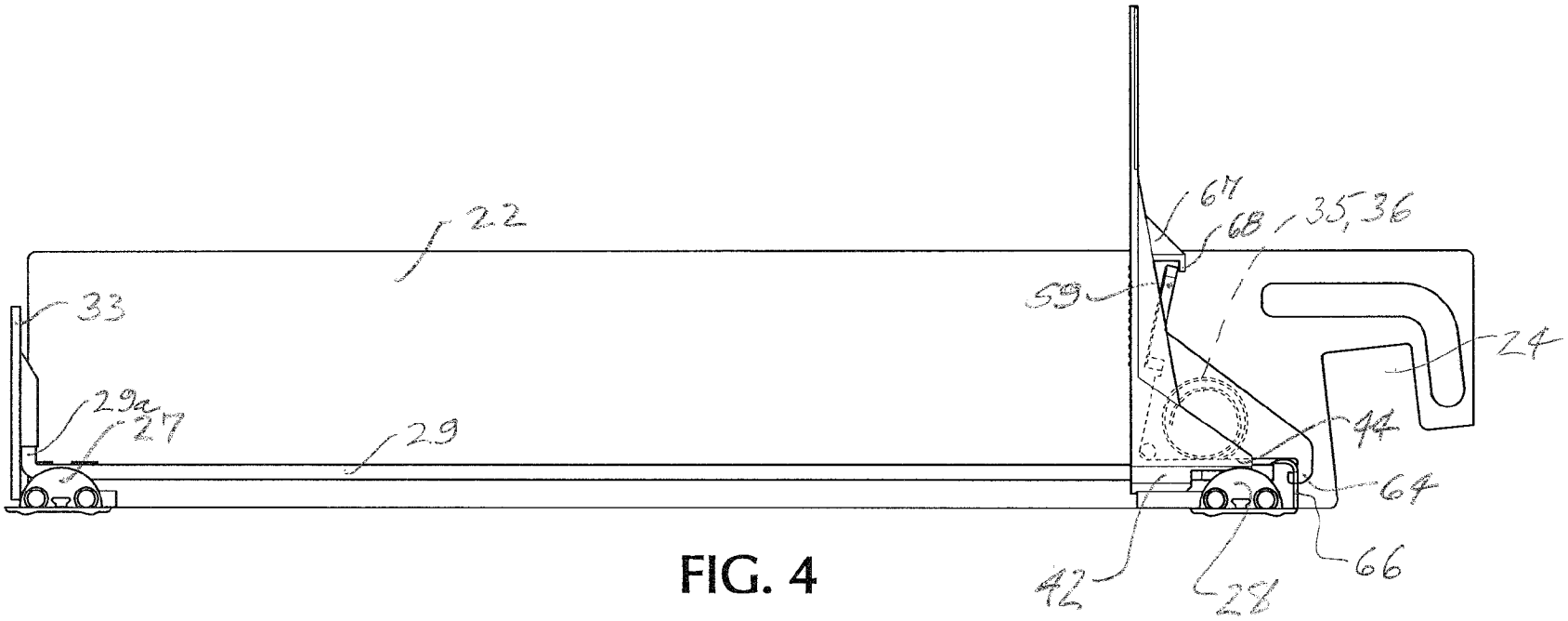
FIG. 4 is a side elevational view, similar to FIG. 3, showing the pusher paddle of the tray in a retracted and locked position.
Figure 5:
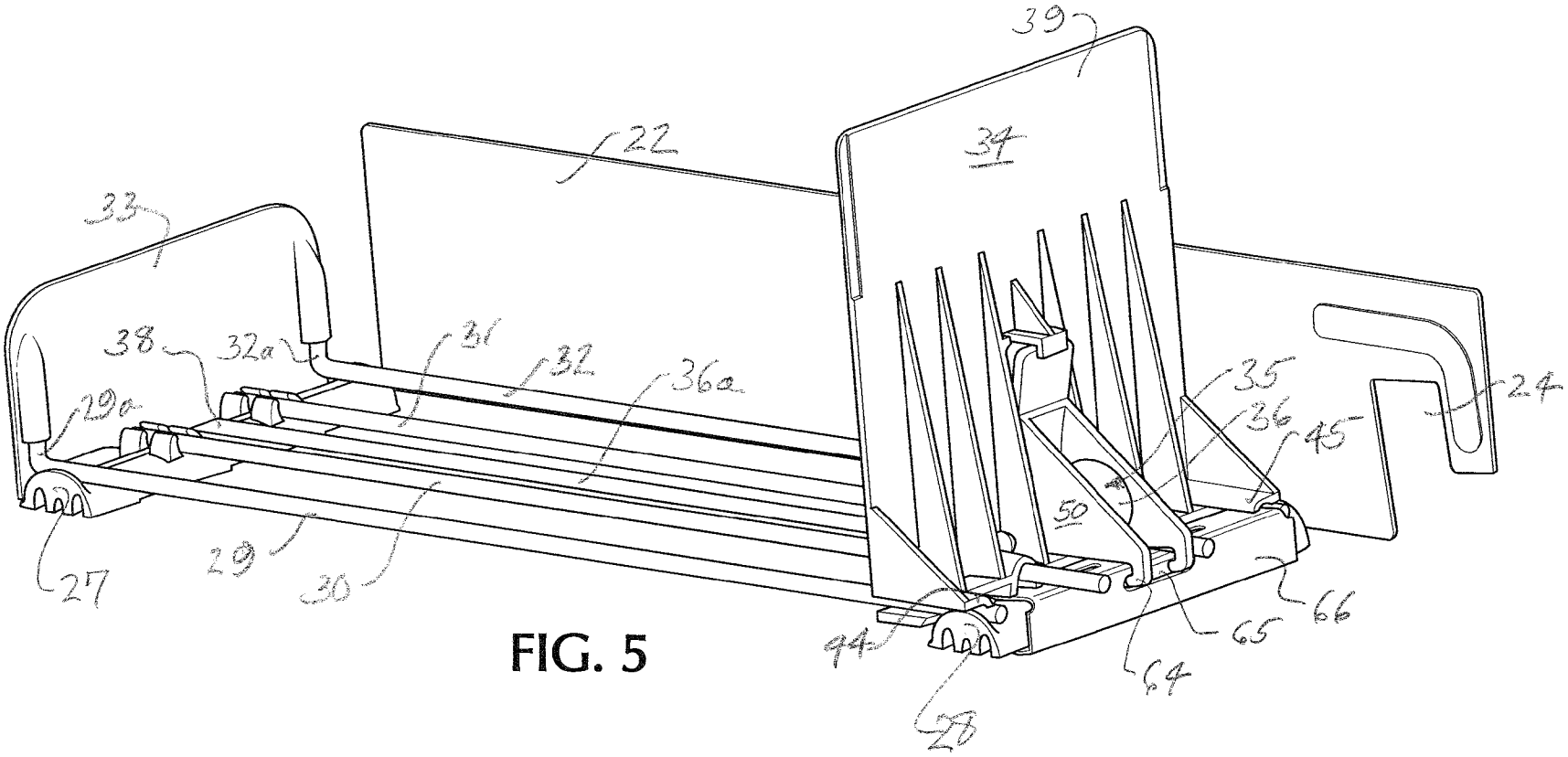
FIG. 5 is a back orthographic view, similar to FIG. 2, showing the pusher paddle in a retracted and locked position.
Figure 6:
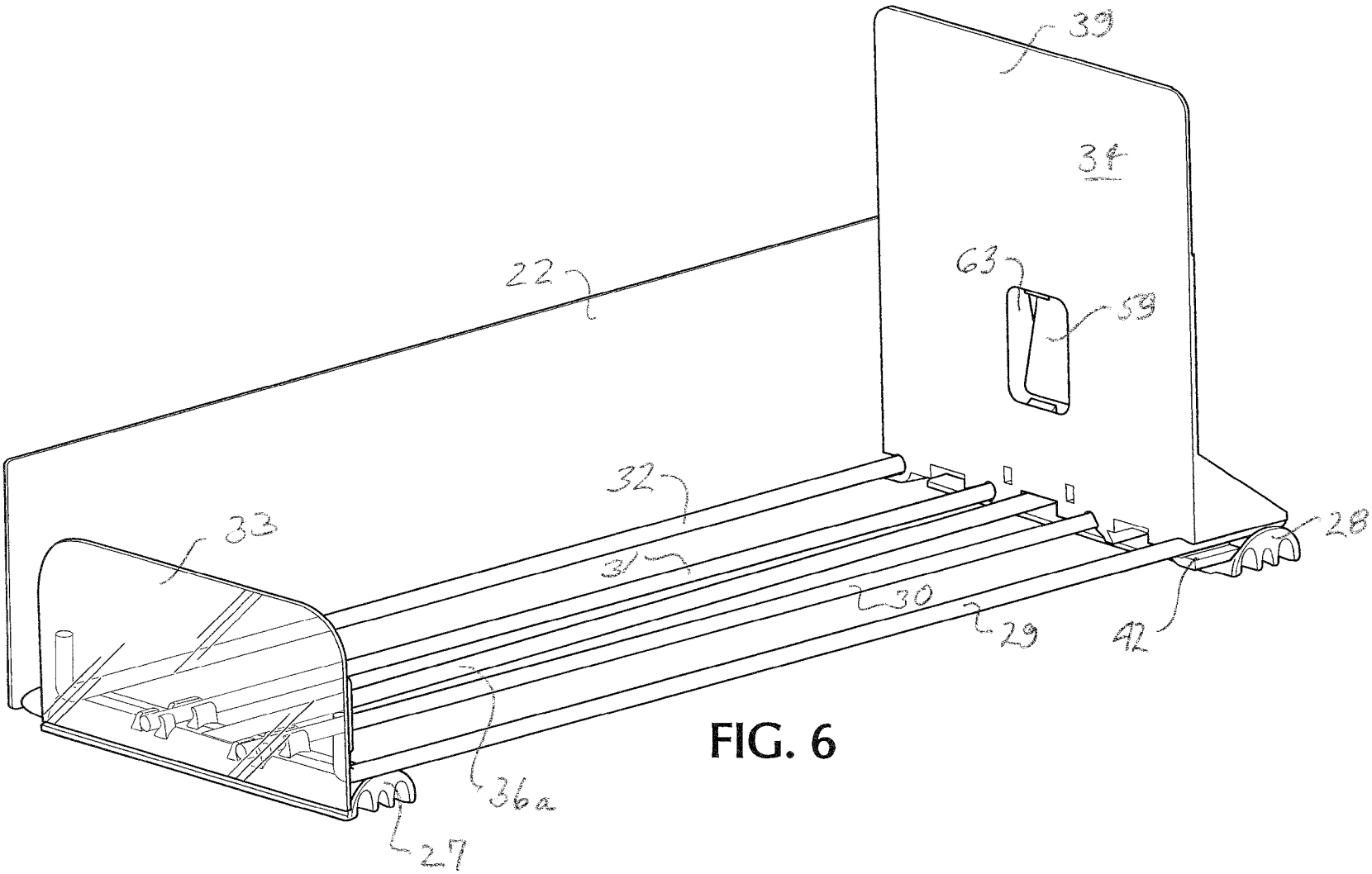
FIG. 6 is a front orthographic view, from above, showing the pusher paddle in a retracted and locked position.
Figure 8:
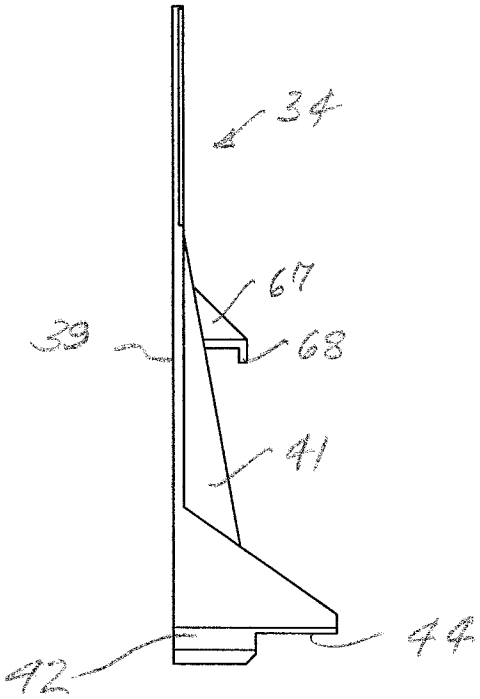
FIG. 8 is a side elevational view of the pusher paddle of FIG. 7
Figure 7:
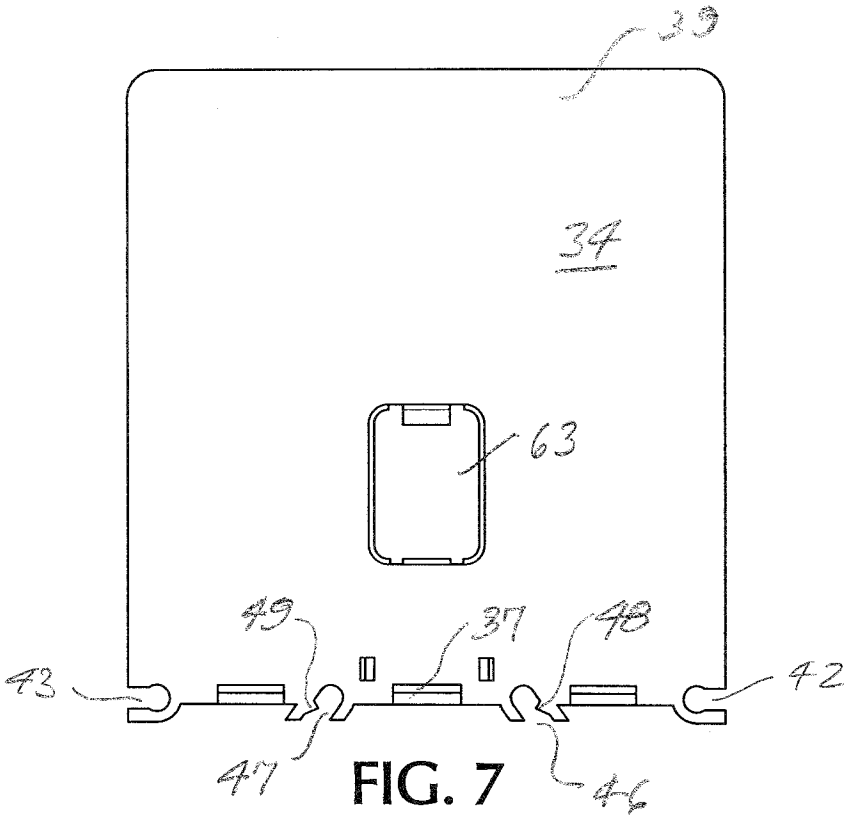
FIG. 7 is a front elevational view of the pusher paddle incorporated in the tray of FIG. 1.

In the arrangement of the invention, when a store clerk moves the paddle 34 to a retracted position for reloading, he or she must intentionally lock the paddle by pressing the locking lever panel 59 rearwardly to pivot the locking lever rearwardly to the position shown in FIGS. 4 and 5. Downwardly projecting, forwardly opening hooks 64, at the backs of the side plates 53, 54 can then be engaged in a slot 65 in a base cover member 66 to secure the paddle 34 in its retracted position.

Desirably, the pusher paddle 34 is provided with a stop element 67 which projects rearwardly from a position directly above the access opening 63 and is formed with a downwardly projecting flange 68 positioned to engage upper back portions of the actuating panel 59 of the locking lever 50, when the lever is displaced rearwardly a predetermined distance relative to the paddle 34. When the flange 68 is engaged by the panel 59, the hooks 64 are positioned at a proper level to be received in the slot 65 of the base cover.

When a reloading operation has been completed, the pusher paddle 34 is released by displacing it rearwardly until the hooks 64 disengage from the slot 65. As soon as the hooks are disengaged, the locking lever 50 is automatically pivoted forwardly by the action of the spring body 36 against the flanges 60, 61 of the locking lever. Frequently, but not necessarily, the pusher paddle is displaced rearwardly upon placement of the final package into the tray. Otherwise, the operator manually displaces the paddle to release the lock.

Figure 15:
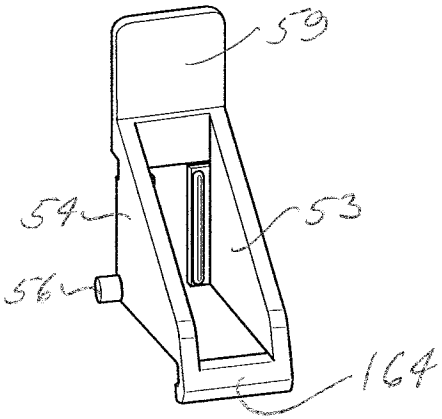
FIG. 15 is a back elevational view of a modified form of locking element that can be used in the display tray of the invention.
Figure 14:
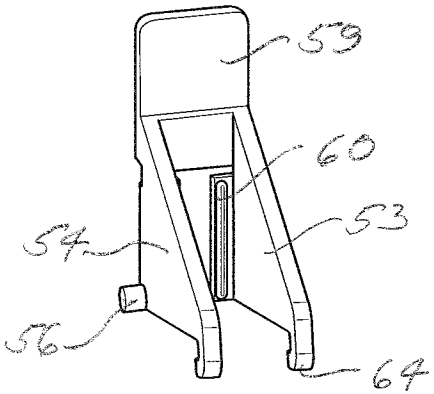
FIGS. 13 and 14 are front and back orthographic views respectively of the locking element of FIG. 11.

In a modified form of the locking lever 50, shown in FIG. 15, a single hook portion 164 extends continuously from one side plate to the other such that the rearward ends of the two side plates 53, 54 are rigidly connected. The locking lever of FIG. 15 functions in the same manner as that of the previously described embodiment.

The mechanisms of the invention are advantageous in requiring intentional operator action to lock the pusher paddle in a retracted position. However, unlike with prior art devices, the desired functions of the locking mechanism do not require a special spring but are accomplished by an advantageous placement of the locking lever so that the force of the coiled strip spring, which is provided to impart forward biasing to the pusher paddle, can be harnessed to also provide rotational bias to the locking lever in a release direction. This is accomplished in the described embodiment by pivotally mounting the locking lever adjacent the bottom of the pusher paddle, with the coiled body of the spring pressing forward on an upwardly extending actuating arm of the lever. The spring acts to provide forward bias to the actuating arm of the locking lever and also acts through the locking lever to provide forward bias to the pusher paddle. Locking of the pusher paddle in a retracted position for reloading of the tray requires both that the pusher paddle be moved to a retracted position and additionally that the actuating arm of the locking lever be manually pressed backward, through the access opening 63 in the pusher paddle.

The mechanism of the invention also provides improvements in the manner in which the pusher paddle is mounted on its guide rods. In an arrangement including at least four guide rods, the base of the pusher paddle is provided with outwardly opening, horizontally disposed U-shaped guide sleeves for the reception of the outermost guide rods. A pair of inner guide rods is received in downwardly divergently opening U-shaped guide sleeves, each of which is formed with an internal detent projection requiring forcible snap-in and snap-out assembly and disassembly. The guide sleeves are elongated relative to the diameter of the rods, providing stability to resist tilting forces imparted by the coiled spring and or by store personnel moving the paddle. Additionally, at least certain of the guide sleeves, including the outermost sleeves are further elongated in their upper portions, providing additional stability to resist rearward forces, as when moving the pusher paddle to a reload position, at the back of the tray.

It should be understood, of course, that the specific embodiments of the invention herein illustrated and described are intended to be representative only, as certain changes may be made therein without departing from the clear teachings of the disclosure. Accordingly, reference should be made to the following appended claims in determining the full scope of the invention.

What is claimed is:

1. In a merchandise display tray of the type having a tray base for the support of merchandise and provided with elements at a back thereof for mounting the tray base in cantilever fashion, a spring-urged product pusher mounted on said base for urging said merchandise forwardly on said base, a coiled strip spring positioned with a coiled portion thereof behind said product pusher and an uncoiled strip portion thereof extending forward and secured in a forward portion of said tray base, and means for temporarily locking said spring-urged product pusher in a retracted position for reloading of the tray, the improvement in said means for locking comprising said product pusher being formed of a rigid plastic material and comprising an upright panel, engageable with merchandise supported on said tray base, and a bottom portion extending rearwardly from a lower portion of said upright panel and slidably guided and supported by said tray base, a pusher locking element pivotally attached to a back of said product pusher to be movable therewith and pivoted about a pivot axis disposed transversely to said tray base, said pusher locking element having a locking leg extending rearwardly from said pivot axis and an actuating arm extending upward from said pivot axis, said transversely disposed pivot axis being located at a lower back portion of said product pusher, and said actuating arm extending upward along a back face of said upright panel, the coiled strip spring acting on said locking element to urge said actuating arm to pivot in a first direction, toward said release position, to position said locking leg in an elevated, release position and said actuating arm in a forward position, said locking element being manually pivotable in a second direction, to position said locking leg in a depressed, locking position, by the application of rearward manual force to said actuating arm, to enable locking of said product pusher in a retracted position, said pusher locking element being releasable from said locking position by temporary rearward movement of said product pusher to allow pivoting movement of said pusher locking element in said first direction and thereby free said product pusher for forward movement by said coiled strip spring said actuating arm is positioned between the coiled portion of said coiled strip spring and the back face of said upright panel, whereby said spring urges said actuating arm forwardly to pivot said locking element in said first direction while simultaneously urging said product pusher in a forward direction.

2. The improvement of claim 1, wherein said upright panel has an opening therein providing manual access through said opening to said actuating arm for manual pivoting of said pusher locking element in said second direction to lock said product pusher in a rearwardly retracted position.

3. The improvement of claim 2, wherein said pusher locking element has a portion thereof engageable with said product pusher and defining a first limit position restricting pivoting movement of said pusher locking element in said first direction, and said actuating arm has a forwardly projecting element extending forwardly into said opening and accessible through said opening for manual displacement to pivot said pusher locking element in said second direction.

4. The improvement of claim 3, wherein the portion of said pusher locking element engageable with said product pusher comprises a portion of said actuating arm extending upwardly from said pivot axis and having a forwardly facing surface engageable with the back face of said upright panel to define said first limit position.

5. The improvement of claim 3, wherein a limit stop element extends rearwardly from the back face of said panel to a position behind a portion of said actuating arm to define a second limit position restricting pivoting movement of said pusher locking element in said second direction.

6. The improvement of claim 1, wherein said locking element includes first and second laterally spaced apart locking legs extending rearward from said actuating arm, and the coiled portion of said coiled strip spring is laterally confined between said spaced apart locking legs and confined at a front thereof by said actuating arm.

7. The improvement of claim 6, wherein said product pusher is formed on its back side with integral, laterally spaced apart gusset panels supporting said upright panel and serving to closely laterally confine opposite sides of said locking element, said gusset panels are provided, near lower ends thereof, with one of axially aligned pivot openings or axially extending pivot pins, lower portions of said locking element are formed with one of axially projecting pivot pins or axially aligned pivot openings for pivotally mounting said locking element to said gusset panels, and lower portions of said actuating arm are adapted to accommodate resilient inward flexing of opposite side elements of said lower portion for assembly of said pivot pins into said pivot openings.

8. The improvement of claim 6, wherein said locking legs are provided at rearward portions thereof with forwardly opening hook portions for locking engagement with back portions of said tray base, and a cross bar element is integrally molded with and extends between rearward end portions of said first and second locking legs.

9. The improvement of claim 8, wherein said cross bar element forms a continuous forwardly opening hook portion.

* * * * *